US007165706B2

(12) United States Patent
Barr

(10) Patent No.: US 7,165,706 B2
(45) Date of Patent: Jan. 23, 2007

(54) MODULAR PACK SYSTEM WITH BELT AND LEG BAGS

(75) Inventor: Jarrod Barr, Meridian, ID (US)

(73) Assignee: Summit Equipment Company, Inc., Sergeant Bluff, IA (US)

( * ) Notice: Subject to any disclaimer, the term of this patent is extended or adjusted under 35 U.S.C. 154(b) by 566 days.

(21) Appl. No.: 09/927,433

(22) Filed: Aug. 10, 2001

(65) Prior Publication Data

US 2003/0000987 A1 Jan. 2, 2003

Related U.S. Application Data

(60) Provisional application No. 60/224,445, filed on Aug. 10, 2000.

(51) Int. Cl.
*A45F 3/00* (2006.01)

(52) U.S. Cl. ..... 224/661; 224/665; 224/666; 224/667; 224/672; 224/677; 224/682; 224/684; 224/904

(58) Field of Classification Search ..... 224/197, 224/661, 663, 665, 666, 667, 671, 672, 677, 224/682, 684, 904
See application file for complete search history.

(56) References Cited

U.S. PATENT DOCUMENTS 2,543,313 A * 2/1951 Dietzen ..... 224/677
4,303,187 A * 12/1981 Berman ..... 224/661
4,848,624 A * 7/1989 Clem ..... 224/682
5,215,238 A * 6/1993 Baruch ..... 224/661
5,445,303 A * 8/1995 Cawile, Jr. ..... 224/684
5,490,618 A * 2/1996 Davidson ..... 224/677
5,765,738 A * 6/1998 Hoffner ..... 224/661
5,868,652 A * 2/1999 Spletzer ..... 224/222
6,065,659 A * 5/2000 Faz ..... 224/661
6,149,042 A * 11/2000 Rassias ..... 224/661
6,216,931 B1 * 4/2001 Trawinski ..... 224/682
6,398,092 B1 * 6/2002 Ansley ..... 224/665

* cited by examiner

*Primary Examiner*—Gary E. Elkins
(74) *Attorney, Agent, or Firm*—Black Lowe & Graham, PLLC

(57) ABSTRACT

A modular leg pack system is shown and described, embodiments of which include a belt or belt sleeve for wearing around the body, and preferably at the top of the hips, and preferably two thigh opposing bags. The thigh bags extend from just below the belt to above the knee. One or more top connectors attach the top of the bag to the belt, and a bottom leg strap extends from the bottom of the bag around the inside of the leg. To assist in natural movement of the bag with the leg, the preferred top connectors have a pivot point that allows the bag to pivot in a direction parallel to the motion of the leg. Additionally, it is preferred to have the top connector rotatable relative to the belt in a plane perpendicular to the outer surface of the belt, and rotatable relative to the bag in a plane perpendicular to the back plane of the bag. Openings of the bags are positioned to be easily accessible by the user, usually on the top of the bag.

10 Claims, 10 Drawing Sheets

7A

Side View Right Leg
Front View Right Leg
Compression Straps 22
24
32
32'
114
114'
Length
Width
Thickness
17"
4"
3"
5"
3"
2 1/8"

52
52
34
34
54
54
60
60
14A
Fig.
14B
Fig
uses
Conventional
belt

MODULAR PACK SYSTEM WITH BELT AND LEG BAGS

This application claims priority of prior, co-pending application Ser. No. 60/224,445, filed Aug. 10, 2000, which is herein incorporated by this reference.

BACKGROUND OF THE INVENTION

1. Field of the Invention

Generally, the invention relates to packs for recreational, sport, hunting, and exercise use, which are used to carry supplies or possessions that are needed on a hike, ride, walk, horseback ride, etc. More specifically, the invention relates to a leg pack system that includes bags that are positioned near and connected to the legs of the user. Preferably, the bags hang from a waist belt along the outside of the user's thigh, and extend between the belt and the user's knee.

2. Related Art

Many back packs have been developed for carrying equipment, food, and personal items during hiking, walking, climbing, and other outdoor sports and recreational activities. The term "backpacking" has become nearly synonymous with hiking while carrying supplies and equipment on one's back. The technique of carrying supplies/equipment in a backpack has many drawbacks, however. The backpack moves the user's center of gravity upwards and backwards, which tends to throw the user off-balance and makes many activities clumsy, difficult, and sometimes even dangerous. The backpack attaches a large, weighty object in back of the user, which, when the user is moving quickly, can create unpredictable forces on the user. For example, wearing a backpack while climbing or hiking over steep or difficult terrain greatly increases the chance of the user falling. Further, the pleasure of hiking, running, climbing, biking, horseback riding, and other activities is diminished if the user must be more conscience of his motions and his balance due to a backpack.

Attempts at pack systems for the leg have been made, but none offer the efficiency, comfort, and safety of the present invention during a wide variety of outdoor activities, including hiking, running, horseback riding, and skiing. Clem (U.S. Pat. No. 4,848,624) discloses a "Thigh Mountable Small Modular Pack System with Demountable Interchangeable Pouches." The Clem device is a rectangular, rigid box structure, with several compartments and lids. Clem discloses a single buckled strap for surrounding a user's conventional belt, or a waist belt that integrally extends from the device. The Clem device has a rectangular, planar back plate that does not conform to the user's thigh. The present inventor believes the angular, rectangular, and thick shape of the Clem device would cause discomfort to the user's leg and would cause discomfort to the user's arm when the arm swings back and forth, thus making any but the most sedentary use impractical and uncomfortable. Berman (U.S. Pat. No. 4,303,187) discloses a "Multiple Pocket Clothing Accessory," which includes a single, broad upper portion of cloth extending integrally from the pocket and around a user's conventional belt.

SUMMARY OF THE INVENTION

The present invention is a modular leg pack system that includes a hip belt, and preferably a plurality of leg bags extending down from the hip belt on the right and left side of the user to contact the right and left outer surface of the thigh, typically the outer surface of the clothed thigh. The leg pack system is made modular, but providing a plurality of bags of various designs that may be attached to the hip belt, and that may be interchanged for various activities and duration of activities. The hip belt plurality includes at least two connectors, at least one on each side for each thigh, and a plurality of bags preferably comprise cooperating attachment points/connectors for mating/connecting to the connectors on the belt. In addition, bags may be designed to slide onto an end of the hip belt, with the belt extending through a loop/sleeve in the back or top of the bag.

Objects of the invention include:

1. Lowering the center of gravity of the bag assembly on the loaded user, so that the user is not so top-heavy and off-balance.

2. Place the weight on the body in such a way that the strongest parts of the body are carrying the heaviest loads.

3. Enable the user to access his/her gear while engaged in the activity, thus eliminating the need to remove, turn and twist the pack to access gear contained in or on the pack.

As a result, convenience, comfort, and safety are increased during use of the invented system even in very active circumstances, such as running, rigorous hiking, biking, rock and hill climbing, skiing, and horseback riding, for example.

The preferred system includes a single hip belt specially designed to cooperate with many different leg bags, waist bags, side bags, bladder-style. The single hip belt may take the form of a belt, with bag connectors, that buckles or otherwise fastens around the user's waist or hips, or may take the form of a slide-on sleeve, with bag connectors, that slides onto a user-provided belt, such as his own belt or an existing hip belt provided as part of other equipment such an internal frame pack.

The leg bags, and any other bag or item attached to the hip belt, are preferably designed to quickly detach from the hip belt. This way, the user may acquire a single belt, and may outfit it with different sizes and types of bags depending on the intended activity. This way, the user may interchange bags on the belt so that he/she can go from one activity to another and still utilize the same hip belt. Also, two people with two belts and a variety of bags may share the various types of bags, because the bags can be moved to any cooperating belt made according to the invention.

Preferably, two leg bags are used, one on the right outer thigh region and one on the left outer thigh region, with the leg bag starting within a few inches of the hip belt and extending down toward, but not to or past, the knee. Having a right and a left leg bag keeps the center of balance from right to left uniform. Also, having the two leg bags not extend significantly forward, or rearward, from the front and the rear of the thigh, respectively, keeps the center of balance from front to rear uniform. In other words, by mounting the leg bags on the sides of the thighs, and not on the front or back of the user, the leg bags have a minimum effect on the center of gravity and center of balance of the user, thus allowing the best mobility and freedom of movement during outdoor activities.

In addition to the two leg bags, a small horizontally-disposed bag or, most preferably, a water bladder, water bottle, or rolled-up clothing item, may be connected to the belt at the back of the belt, preferably by use of an encircling-strap system. This back-mounted object should be a small object, so as not to significantly affect the center of gravity nor to affect the user's balance. Also, this back-mounted object should be an item or container that is not accessed frequently, as it may be difficult to do so compared to the easily-accessed leg bags.

In addition, small bags may be positioned on the hip belt directly above one or preferably both thigh bags. These may be connected to the hip belt by means of a loop/encircling-strap system, and preferably the loop/strap is positioned between the two connectors on the belt that hold the thigh bags.

Preferably, the leg bags are connected by quick release connectors to the hip belt, with the quick release connectors being easily accessed between the top of the bag and the belt. Preferably, each bag has a leg strap that extends around the inner, lower portion of the thigh, above the knee. Thus, each thigh bag is secured to the belt and to the leg. Medium and large bags typically are connected at two locations to the belt, with the two connectors preferably being spaced several inches apart on the belt, for example, about 4–8 inches apart and preferably about 6 inches. Small bags may utilize either one or two connections to the hip belt, and preferably one. Each of the connectors for small, medium, and large bags is preferably a quick-release (and, likewise, a quick-attach) mechanism. Each of the leg straps preferably includes a quick release (and quick-attach) buckle or other fastener.

The number and spacing of top connectors, and the preferred single leg strap, are designed to eliminate, or at least minimize, movement of the bag relative to the thigh, and particularly "wobble" of the bag on the thigh. Wobble is movement of the bag relative to the leg around the longitudinal axis of the bag (axis from top center to bottom center of the bag) and/or radial movement of the bag around the thigh. Some slight movement of the bag relative to the thigh is acceptable, because only one strap around the leg is preferred and the single leg strap is preferably not cinched extremely tightly. In general, however, performance of the invented pack system is optimized because the bags are positioned and move along with the thigh, but do not significantly move relative to the thigh, and the bags do not cause the forces that create an off-balance situation for the user. For medium and large bags, having two spaced connectors at the top of the bag and one leg strap substantially prevents movement of the bag relative to the leg, and particularly eliminates wobble. The two top connectors for medium and large bags also spread out the downward forces of the bag on the belt. The preferred single top connector for small bags is typically sufficient because the small bag is not loaded with enough weight or volume to cause significant or irritating movement/wobble.

The preferred shape of the thigh bags is beneficial to the comfort and effectiveness of the pack system. In this application, the length of the bag is the dimension from the top of the bag to the bottom of the bag, as the bag is installed on the belt and the user's leg. The width of the bag is the dimension between the leading side and the trailing side of the bag, and the thickness is the dimension from the bag surface against the thigh ("back surface") to the bag surface facing outward away from the user (the "front surface"). Each thigh bag is preferably narrow in width at the top and increases in width toward the bottom. Also, each bag is preferably thin at the top and increases in thickness toward the bottom. This narrow and thin profile at the top of the bag allows for natural arm movement and natural arm swing. In this way, the arm tends not to hit or rub against the bag during use, which is a great benefit to comfort and convenience—if the user bruises or callouses his arm, or if he/she has to change his natural movement, gait, or arm swing to accommodate a pack system, then the pack system is impractical and undesirable. Also, the preferred flexibility and cloth/fabric material of the outer and upper surfaces of the non-angular bag shape ensures that, if the bag is hit by the user, it will not be damaging or hurtful. With the invented system, the bag shape minimizes or eliminates any changes in movement, gait, and arm swing, and so is a more natural and comfortable recreational/sporting accessory.

The bags optionally may have a compression system to compress the bag around the contents of the bag. The compression system may be compression straps on the outside front surface of the bags, of the style of crossing strings that may be tightened like the lace through the eyelets in a lace-up shoe. Other styles of compression members may be used, as long as they pull and fasten the bag material in such a way as to remove excess space in the bag and tighten the bag around the contents. Internal compression straps may also be used, especially for application in which external compression straps/strings may snag or catch on brush, twigs or other objects. Another example of compression members may be straps or strings that do not cross over each other, but that cinch or pull or wrap around the bag in some manner to squeeze the bag and, hence, minimize the volume of the bag around its contents. Compression straps tend to keep the gear inside the bag from shifting and moving while the user is engaged in the outdoor activity, because, in a like manner to shifting and wobbling of the bag, the shifting and moving of the gear inside the bag could create an unbalancing or uncomfortable situation for the user.

In addition to the connection(s) at/near the top of the bags being quick-attach and quick-release, preferably each connection for bags extending down from the belt includes a pivot point wherein the bag may pivot relative to the belt in a plane generally parallel to the outermost side surface of the leg (parallel to the direction of travel as the user walks forward). The bag pivots in a swinging action that allows the bag to move easily with the leg. Preferably each connector has a pivot axis that extends horizontally and perpendicularly to the surface of the belt at the side of the user, and the pivot axis is preferably located between the top of the bag and the bottom edge of the belt. In other words, each pivot axis extends generally laterally relative to the users direction of travel. The preferred connector includes: 1) an extension strap or other extension member between the belt and the bag to position the topmost surface of the bag about 2–6 inches (preferably about 3 inches) from the bottom edge of the belt; and 2) the pivot axis. By including a pivot axis, the extension member and the bag do not themselves need to, and preferably do not, twist, turn or bend. Instead, the connector pivots at the pivot axis purposely designed for consistent and smooth and low-wear movement.

Optionally, the connection(s) at/near the top of the bags may comprise flexible strap(s) that flexes or bends to serve as a pivoting means. For example, two straps may extend from the hip belt to the top region of a thigh bag, wherein the two straps are spaced to serve to spread out the load along preferably 3–6 inches of length of the belt, but the straps are narrow enough and flexible enough so that they may flex and bend as the leg moves the thigh bag relative to the belt. If a single flexible strap is used, preferably it is narrower than the width of the bag at its top end, in order to enhance flexibility and the pivoting action.

The hip belt is important to the effectiveness of the invented pack system. The preferred hip belt is designed so that it is narrower from top edge to bottom edge on the sides and front, and thicker from top edge to bottom edge in the back. This wide back portion resting on the lower back provides excellent structural support for the user. The bags on the right and left side of the user pulls downward on the belt, which translates to force of the belt particularly in the hip area and in the back area, which are both strong and stable areas of the body. Thus, the shape of the belt gives a comfortable fit and provides an especially wide surface on the back to supports the weight and to protect the user's tail bone as well. Likewise, other weight it supported, or at the least, controlled by the thighs, which are other strong areas of the body.

Also, the wide back portion serves as a barrier to help limit movement of bag loop/encircling-sleeves along the belt. For example, in a bag assembly including two thigh bags hanging on each side of the user, and two smaller slide-on bags directly above the thigh bags, the slide-on sleeves of the smaller bags may be sized so that they will not readily slide to the center of the back, because of the wide portion of the belt at the back being wider than the slide-on sleeves.

The inventor envisions a wide assortment of bags and attachable devices for cooperation with the belt. As mentioned above, small, medium, and large bags are available, as well as bags of differing materials, such as woven material, waterproof material, or mesh bags, for example. Mesh bags may be particularly attractive to those who will be in water and do not want: 1) air-holding bags to possibly become a problem by making the user's lower body more buoyant than his/her upper body, or 2) bags to fill with water and reduce the buoyancy of the user.

BRIEF DESCRIPTION OF THE DRAWINGS

FIG. 7A is a rear view of an alternative thigh bag, with a single loop at its top for sliding-on to a hip belt, and a flexible extension between the loop and bag.

FIG. 14A illustrates one embodiment of a hip belt, with snap-on pivot-axis style connectors.

FIG. 14B illustrates another embodiment of a hip belt, with snap-together buckle, flexible-strap connectors.

DETAILED DESCRIPTION OF THE INVENTION

Figure 2:
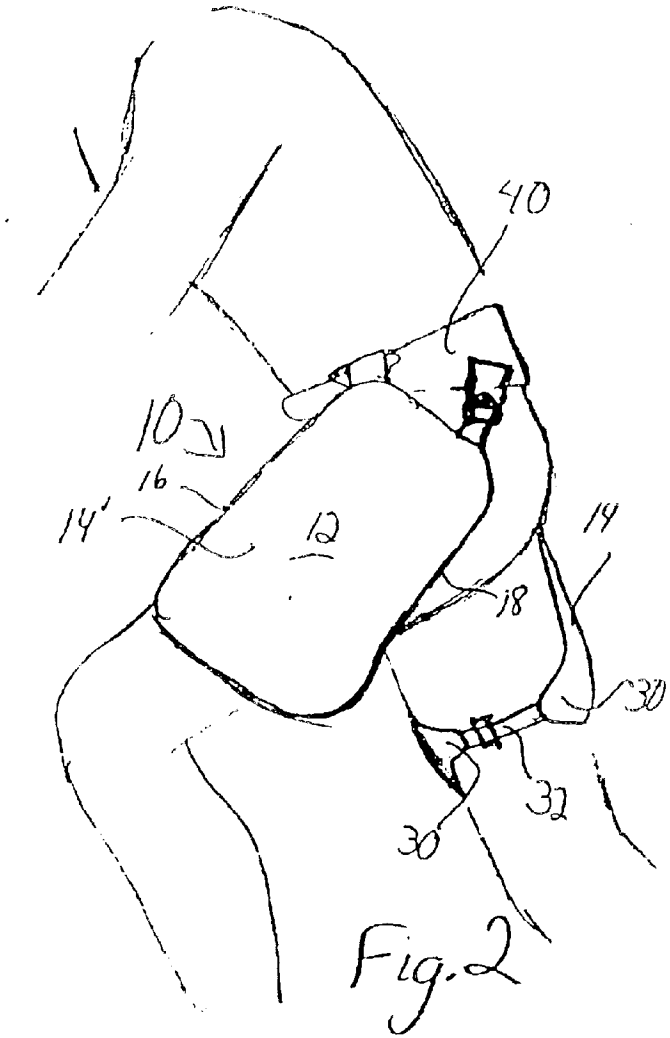
FIG. 2 is a side perspective view of the embodiment of FIG. 1, wherein the left thigh bag of the system is pivoted to the front with the leg of the user.

Referring to the drawings, there are shown preferred, but not the only, embodiments of the invented leg pack system 10. Preferably, the leg pack system includes bags and carried objects that are positioned substantially between the waist and the knee, and not below the knee. Preferably, the leg pack system includes bags and carried objects at both sides of the user, substantially equally distributed between right and left side, and optional small bags and objects on the back or the front.

Figure 1:
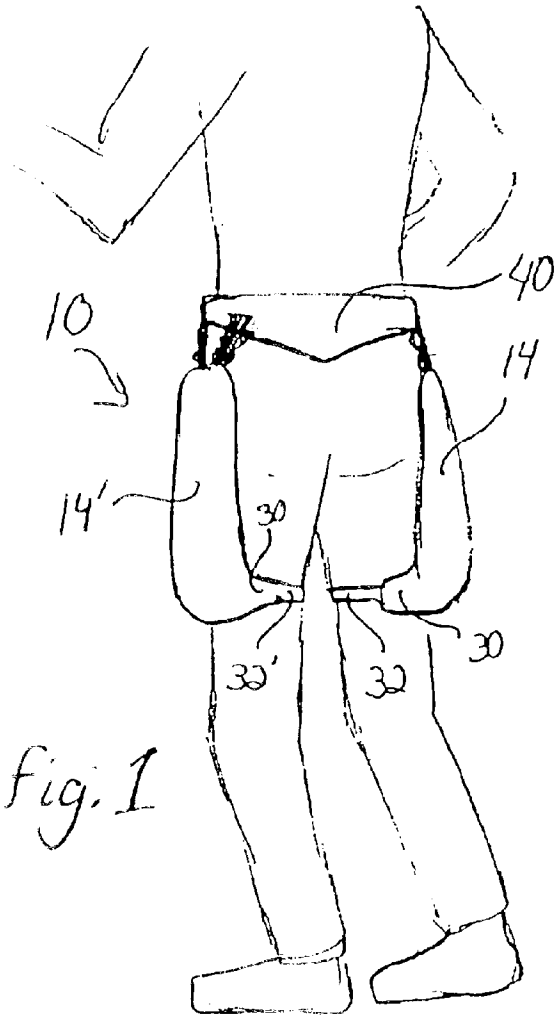
FIG. 1 is a rear perspective view of one embodiment of the invented modular bag system on a user.

As illustrated in FIG. 1, a preferred modular leg pack system 10 comprises a right thigh bag 14 and left thigh bag 14', on a hip belt 40 that is fastened around the user's waist or upper hips. The thigh bags 14, 14' extend from a few inches below the belt to a few inches above the knees, and wrap part way around the legs. Each bag has a strap 32, 32' fastened around the leg above the knee, with the leg strap 32, 32' fasteners easily reachable by the user from the front.

Figure 12:
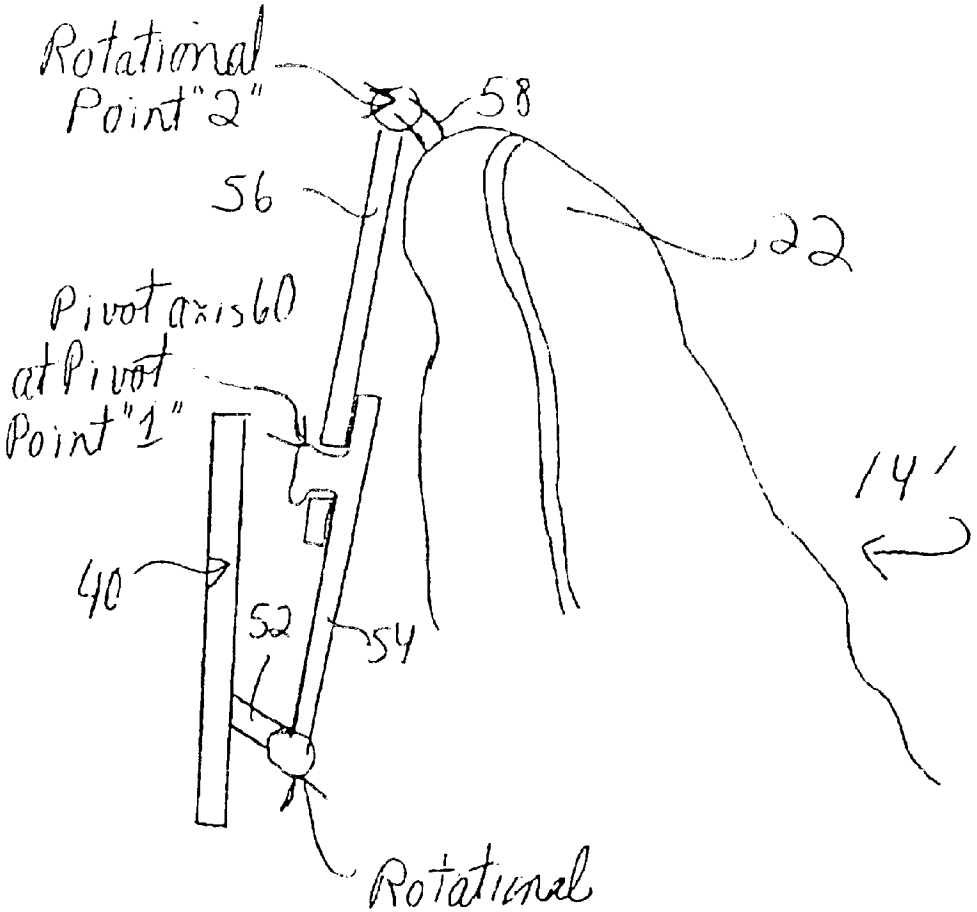
FIG. 12 illustrates one embodiment of a pivot-axis connector that also includes a flip-up features.

FIG. 2 illustrates the leg pack system 10 in use and how the thigh bags 14, 14' pivot relative to the hip belt 40 to move with the user's legs. As discussed later in this Detailed Description, the connection means for the thigh bags 14, 14' preferably includes a pivot feature, which may comprise a connector with a pivot axis or a connector that is flexible and sized for allowing a bag to swing/pivot in a plane generally parallel to the belt, that is, to swing/pivot with the leg. In FIG. 2, the left leg and left thigh bag are pivoted so far forward that the leading pivotal connection of the thigh bag is both pivoted and rotated up against the belt, as schematically portrayed in FIG. 12.

In FIGS. 1 and 2, one may see a left thigh bag 14' front surface 12, and leading side 16 and trailing side 18. The thigh bags 14, 14' may optionally include a thin and narrow top end 22 and a thicker and wider bottom end 24 (see FIGS. 8–10). Leg strap support panels 30 extend out from the bag, perpendicular to the length of the bag. The leg straps 32, 32' extend out from the support panels 30, and may each have a thin, curved-to-leg-contour quick-release buckle. The panels 30 tend to provide a secure attachment point, plus they prevent the strap 32, 32' from sagging down the leg. With panels 30, a firm, sure, and predictably-placed leg strap system provides comfortable and effective connection to the leg above the knee.

Figure 3:
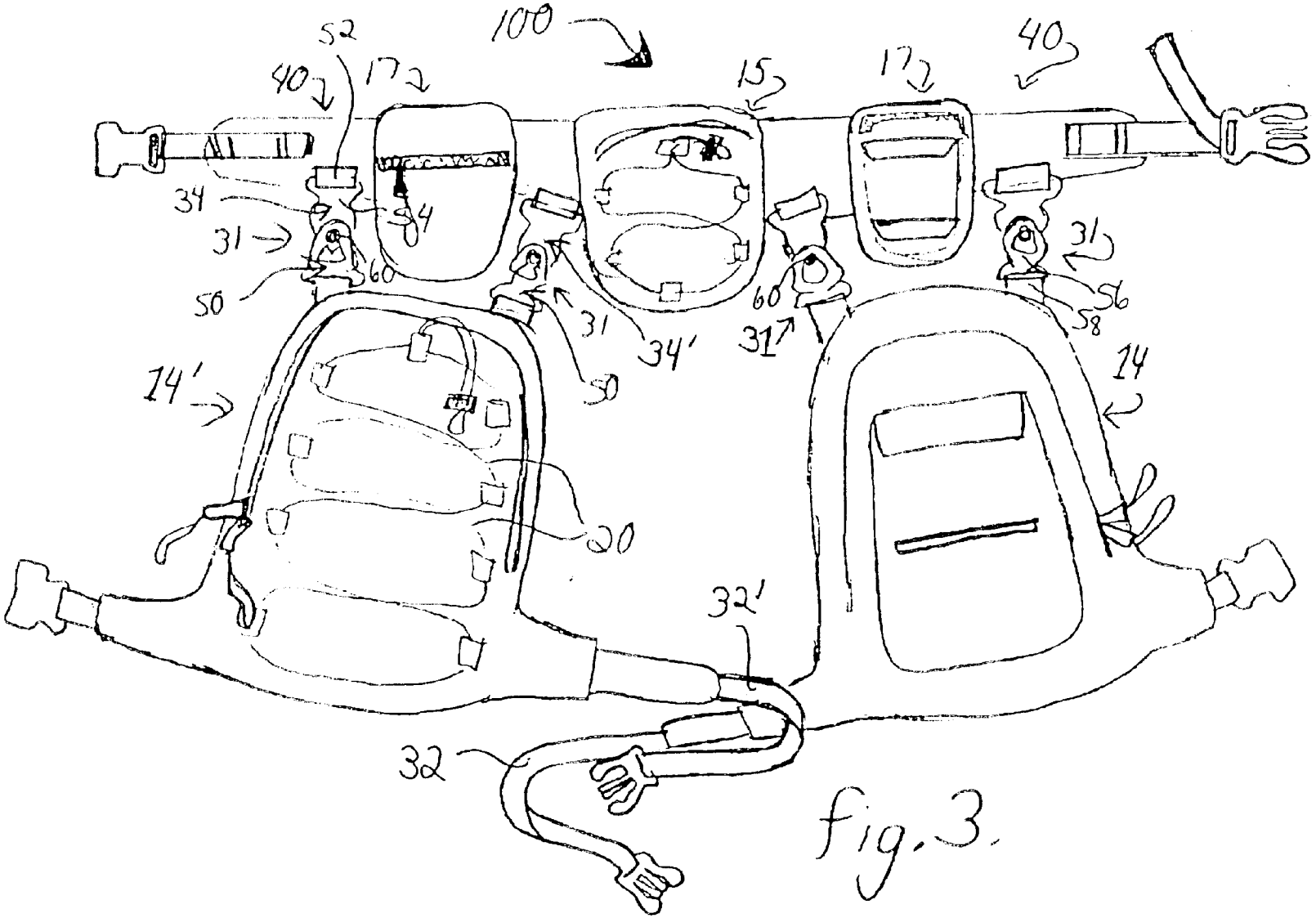
FIG. 3 is a plan view of another embodiment of a modular bag system, including right and left thigh bags, right and left small side bags, and a rear bag, all on one embodiment of an invented hip belt, wherein the system is unattached from a user and flattened-out for viewing.

In FIG. 3, there is shown a modular bag system 100 according to the invention, which shows two thigh bags 14, 14' a center rear bag 15, and two small side bags 17. The two thigh bags 14, 14' are connected by a connector means that includes two connectors 31 made of upper portions 34, 34' and bottom portions 50 that connect together, in a quickly-attachable and quickly-releasable manner. Each connector 31 may include a pivot axis 60, which in the preferred embodiment, comprises the bottom portion 50 rotating around the protrusion on the upper portion onto which the bottom portion snaps.

FIG. 3 (and also FIGS. 14A and 14B to good advantage) illustrate the position and preferred angle of two upper portions of connectors 34, 34' on a hip belt 40. Preferably, the leading upper portion 34 extends generally downward vertically from the belt when it is on the user, that is, generally perpendicular to the length of the belt. The trailing upper portion 34' is preferably non-parallel to the leading upper portion 34, that is, preferably angled toward the leading upper portion 34 (toward the user's front when in use). The preferred angle is in the range of about 25–45 degrees relative to parallel to the leading portion 34 (or, that is, about 65 to 45 down from the longitudinal axis of the belt), but other angles may be optimal for various bags and users. This preferred angled connector provides an attachment point for the bag which tends to position the bag properly on the thigh, and which allows the bag to easily pivot forward during use.

The leg straps 32, 32' of the thigh bags in FIG. 3 are shown to have their lengths substantially located on the trailing sides of the bags. This way, the straps 32, 32' can extend around the inside of the leg to near the front of the leg, for easy fastening by the user. The leg strap support panels 30, in effect, allow a firmer (compared to the leg straps), thin and flat structure to extend out from the bottom of the bag for a total coverage for bag and panels of about 180 degrees around the leg. Because of the firm panels, which flex in one direction (around the surface of the leg) the leg straps do not sag or shift, and excessive tightening of the leg strap around the leg is unnecessary.

Figure 6:
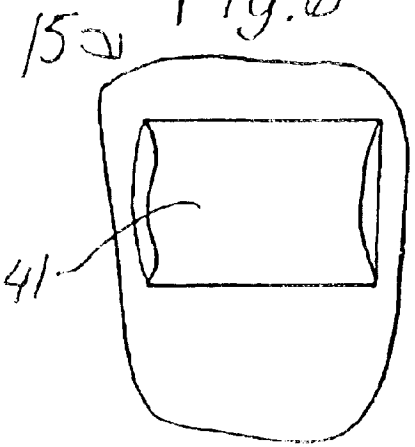
FIG. 6 is a rear view of the back surface of the rear, center bag of the embodiment of FIG. 3, showing a loop for sliding-on to the belt.

The rear center bag 15 in FIG. 3 slides onto the belt 40 by means of its rear loop 41 on its back surface, which is illustrated in FIG. 6. This loop may be substantially the same length as the width of the bag 15, because this rear bag need not, and preferably does not, pivot relative to the hip belt.

The small side bags 17 also slide onto the belt 40 by means of rear loop (not shown). The side bags 17 are preferably sized to slide over, and fit between, the upper portions 34, 34' of the connectors. The upper portions 34, 34' may be flipped up against the main body of the belt to move out of the way of the bag 17 loop, and, when the bag 17 is in place between the upper portions 34, 34', the upper portions may be flipped down for use with thigh bags 14. The connectors may then serve to hold the small side bags in place along the length of the belt.

As illustrated in FIG. 3, right and left bags do not necessarily need to be identical, and the modularity of the invented system allows the bags to be switched or changed or eliminated. Balancing the size and number of bags between right and left is certainly desirable, for ease of movement, safety, and to prevent off-balance walking or damage to muscles or joints. However, the accessory features may be changed, for example, a left thigh bag with outer compression straps 20, and a right thigh bag without compression straps but with multiple outer pockets. A left side bag may include a main zippered pocket, while the right side bag may include multiple outer flaps/pockets. Preferably, no matter what style the various bags are, they include easily assessable openings, which the user may reach without removing or loosening the belt 40.

Figure 4:
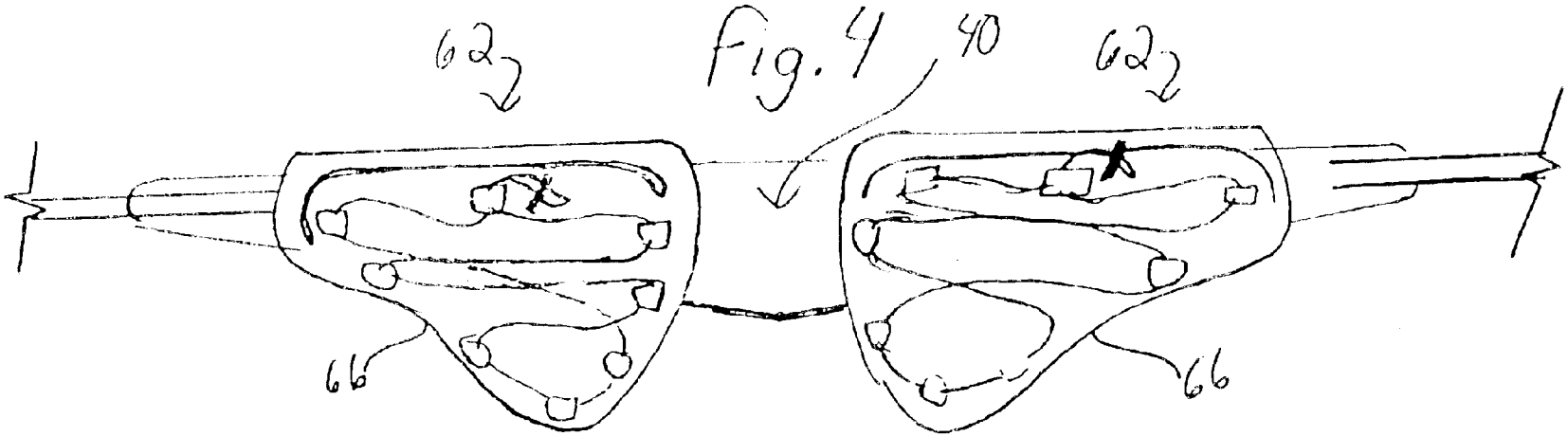
FIG. 4 is an alternative embodiment of the invented modular bag system, including a hip belt and two side bags with contoured shape, wherein the system is unattached from a user and flattened-out for viewing.
Figure 5:
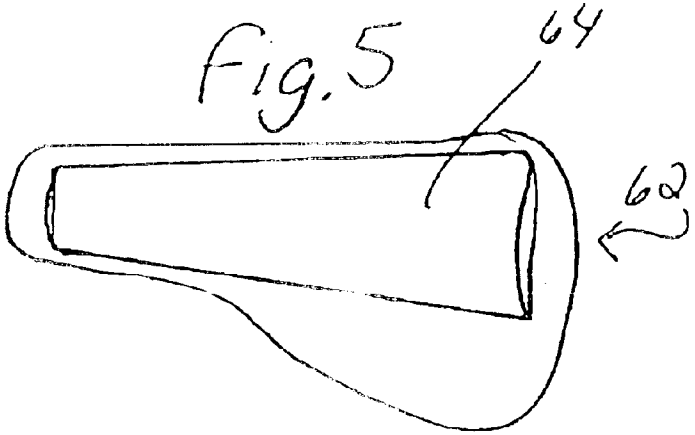
FIG. 5 is a rear view of the back surface of the right side bag of FIG. 4, showing a loop for sliding-on to the belt.

In FIG. 4 is shown an embodiment including a hip belt 40 with two mirror image contoured side bags 62. These side bags slide onto an end of the belt by means of an elongated, tapered sleeve 64 on the back surface of each bag 62, shown in FIG. 5. The contoured lower perimeter 66 of the bag 62 and its small leading end allow free and comfortable movement of the leg, while the larger trailing end positioned at the rear of the upper thigh, out of the way of the leg swing, provides packing volume.

A user may find the invented bag system advantageous in walking, jumping, and climbing. The thigh packs move naturally with the user's legs, without shifting and wobbling. Center of gravity is kept low and centered between left and right (assuming the user has properly packed the thigh bags to about the same weight), in fact, slightly lowered below the natural center of gravity for a person. One can see that the total volume of pack capacity in the invented system is quite large, sufficient for most sporting, recreational, and day-long activities. With the easy assess provided to the bags, it is to access the thigh bags and side bags and the contents of the bags without taking the bags off of the belt, and without any twisting of the body. Therefore, many activities may be comfortably and conveniently undertaken with the pack system, and with the invented leg pack system rather than a conventional backpack system, even biking, skiing, running, or other sports become easy again.

As suggested in FIGS. 1 and 2, the construction of the thigh bags, and their connection to the hip belt, are preferably adapted for easy and smooth pivoting relative to the belt. This may be done by various connectors, for example, the pivot-axis style pivoting connectors shown in FIGS. 1–3, 11, 12, 13A, and 14A, or the flexible style pivoting connectors shown in FIGS. 7A–7C, 13B, 13C and 14B.

In the pivot-axis style connector (best depicted in FIGS. 3 and 14A), the upper portion 34, 34' of the connector comprises a webbing upper strap 52 and a rigid, generally planar, top snap-together rigid member 54. The bottom portion 50 of the connector comprises the rigid, generally planar, bottom snap-together member 56 and a short flexible bottom strap 58. Upper strap 52 is sewn to the hip belt near the bottom edge of the belt, as shown in the drawings, and looped through the elongated slot in top member 54. The bottom strap 56 is sewn to the top of the thigh bag and looped through the elongated slot in bottom member 56. Both the leading connector (L) and the trailing connector (T) preferably have similar construction, but may be installed on the belt at different angles, as discussed above. The leading connector (L) hangs generally straight downward, and the trailing connector (T) is angled slightly forward toward the leading connector. This helps with strength and durability of the connector system, as the two connectors therefore form a V-shape with the top of the bag at the point of the V. Also, this provides good aesthetics for the connectors relative to the curvature of the bottom edge of the belt.

Preferably, snap-together, rigid members 54 and 56 feature a pivot axis 60 near the center of the connector. Members 54 and 56 releaseably connect together, in this embodiment, by one member having an aperture sliding over the pivot axis "post" on the other member, like a "suspender and button hook" system. When connected together, the two members lie in generally a single plane, or in two very close parallel planes in the preferred embodiment, which is/are herein referred to as the "pivot plane(s)". Because of the placement of the hip belt on the user's body, and the connector's position relative to the belt, the pivot plane(s) is parallel to the plane of the outer thigh or clothing on the thigh. The two members 54 and 56 pivot relative to each other in that pivot plane(s), typically with the bottom member 56 pivoting around the post of the top member 54. In addition, as may be seen particularly in the movement of the leading connector (L), the flexible straps or the seem between the flexible straps and the belt and the bag may bend, to allow the rigid connector to flip upwards against the belt, thus allowing the bag to comfortably move up higher against the belt when the leg is far forward (see FIGS. 1 and 12, for example). With these actions of pivoting and flipping-up, the connectors provide greatly improved action for the bag, and greatly improved durability and comfort, compared to what would result from simply a strap of webbing connecting the bag to the belt. This way, the webbing straps or other extension member(s) of the connector do not twist or bend. As stated above, a few inches of strap is desired to place the bag at about 2.5–3 inches from the bottom edge of the belt, but the strap is not needed for pivoting. In fact, the bottom rigid member 56 could be directly sewn/attached to the bag, without a strap 58, in such a way that the bottom rigid member 56 can rotate relative to the bag. Or, the top rigid member 54 could be directly sewn/attached to the belt, in such a way that the top rigid member 54 can rotate relative to the belt. For sake of clarity, herein the term "pivot" is used to describe the action of the connection that allows the connector (or part of the connector) to swing in a plane generally parallel to the belt surface (and the outer thigh and clothing surface), and the term "rotate" is used to describe the action of the connector as it flips up at point 3 in FIG. 12, and the action of the top of the bag relative to the connector at point 2 in FIG. 12. Thus, one may see that preferably each top connector includes three axis of pivoting/rotation, wherein typically two (points 2 and 3 in FIG. 12) are transverse (normal) to the main connector pivot (point 1 in FIG. 12).

The preferred pivot axis 60 is a protruding button or knob that extends out from the upper connector on the belt, combined with an aperture in the lower connector that snaps around/onto, and pivots at least 90 degrees (and preferably more) around, the protruding button/knob. The protruding button/knob, and, therefore, the pivot axis extends horizontally and laterally out from the belt generally at the side of the user.

In use, when the leg is moved from a completely vertical position, the thigh pack travels with it. The pivot connectors typically pivot forward at the pivot axis, and, then, as the leg movement reaches farther forward, the leading connector flips up, as described above. When the leg returns to the vertical position and then a rearward position, the connector flips down and pivots at the pivot axis in the opposite, rearward direction.

It should be noted that other pivotal connectors may be used besides the ones shown in the Figures, and the pivot axis does not necessarily need to be in the center of the connector, but may be nearer the bag or nearer the belt, for example. Preferably, but not always necessarily, the pivot-axis style upper connector portions are substantially rigid, which helps prevent the bag from riding up on the leg, and helps prevent the bag wobbling.

Figure 7B:
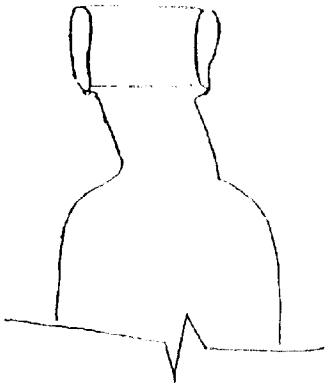
FIG. 7B is a rear view of an alternative thigh bag, with a single loop for sliding onto the hip belt, and two flexible extensions from the loop to the bag.
Figure 7B:
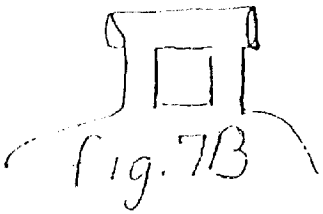
Figure 7C:
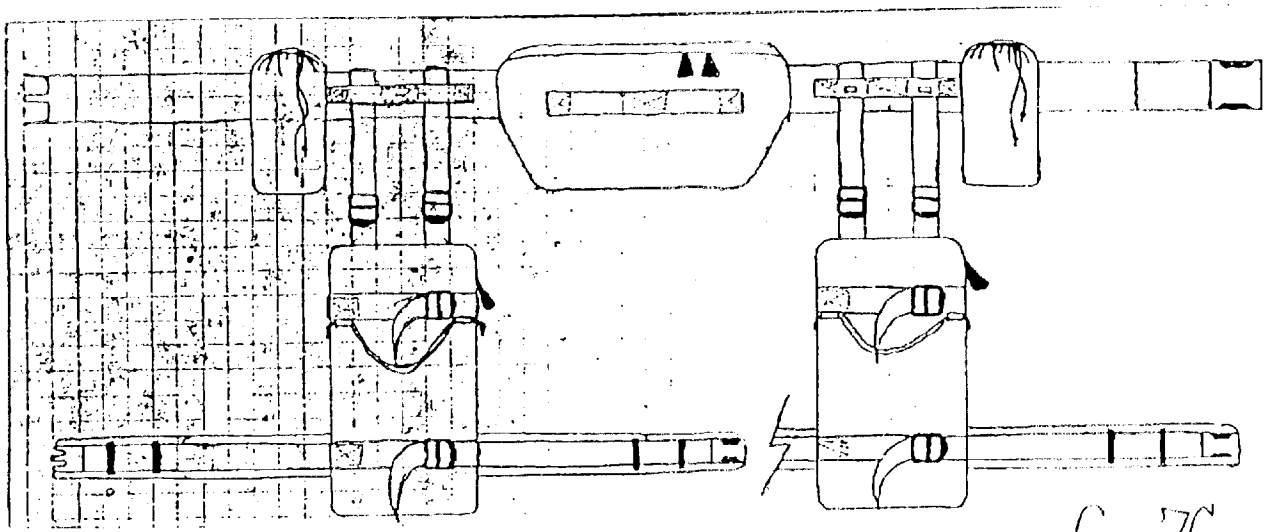
FIG. 7C is a front view of an alternative system according to the invention, wherein each thigh bag has two flexible straps that each connect independently to the belt.
Figure 13A:
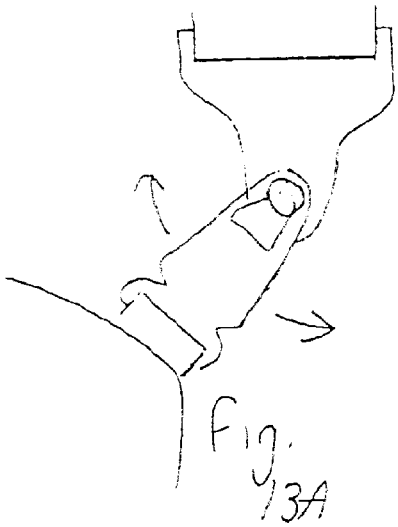
FIG. 13A illustrates one embodiment of a pivot-axis connector.
Figure 13B:
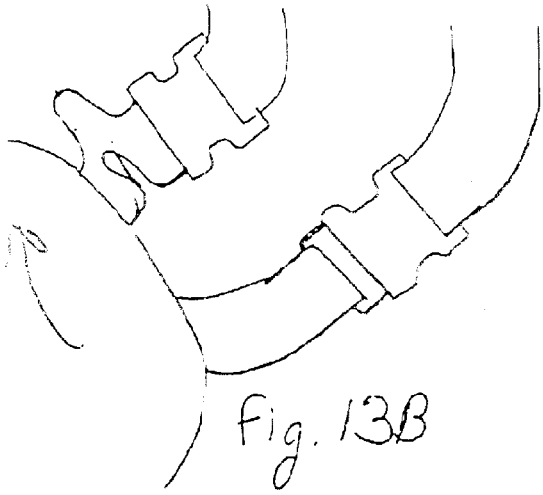
FIG. 13B illustrates one embodiment of a two flexible-strap connector.
Figure 13C:
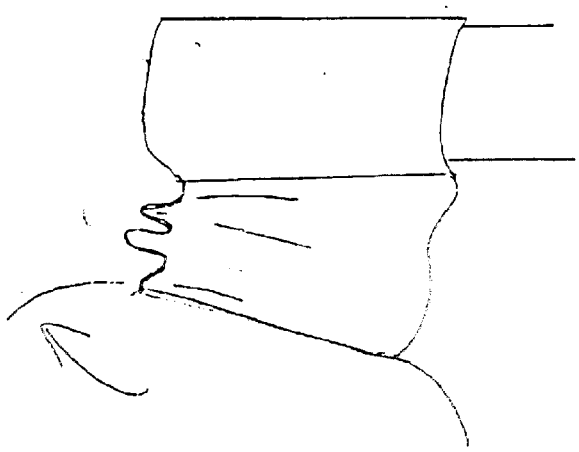
FIG. 13C illustrates one embodiment of a single flexible-strap connector.

The flexible-pivot style of connector is illustrated by examples in FIGS. 7A, 7B, 13B, and 13C, Instead of rigid, pivoting connectors forming a pivot axis, the flexible straps shown in these Figures may serve to flex, and, therefore, to allow the thigh bag to pivot relative to the belt. Two flexible straps are preferred for this style of connector, wherein each strap is independently attached to the belt or wherein the multiple straps are attached to a single loop that extends around the belt. The embodiment of FIGS. 7A and 13C illustrates a single loop around the belt and a single flexible strap to the bag. Preferably, for security and load-spreading, either multiple flexible straps or a wider single flexible strap is preferred.

Figure 8:
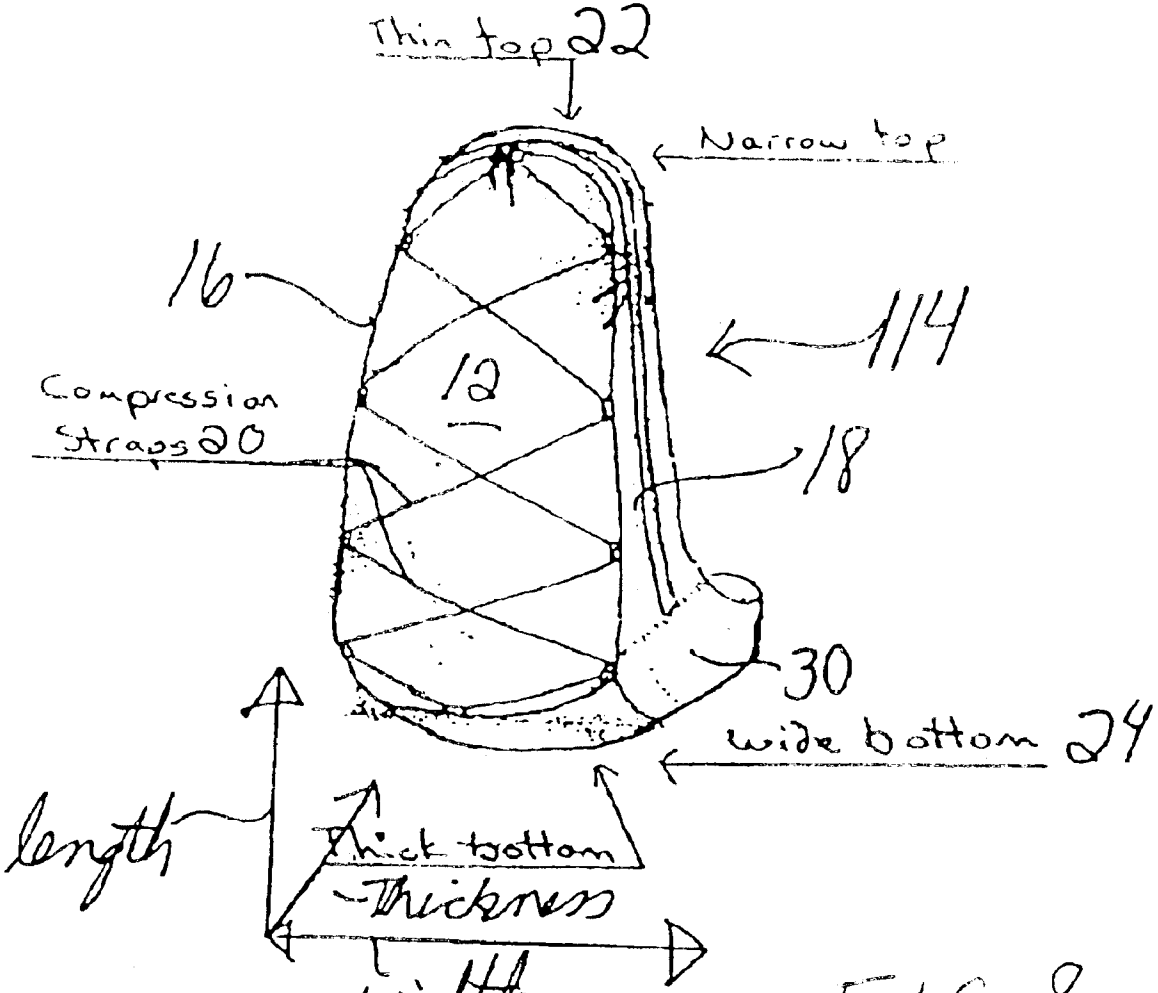
FIG. 8 is a perspective view of one narrow- and thin-topped bag, according to the invention, including compression straps.
Figures 9, 10:
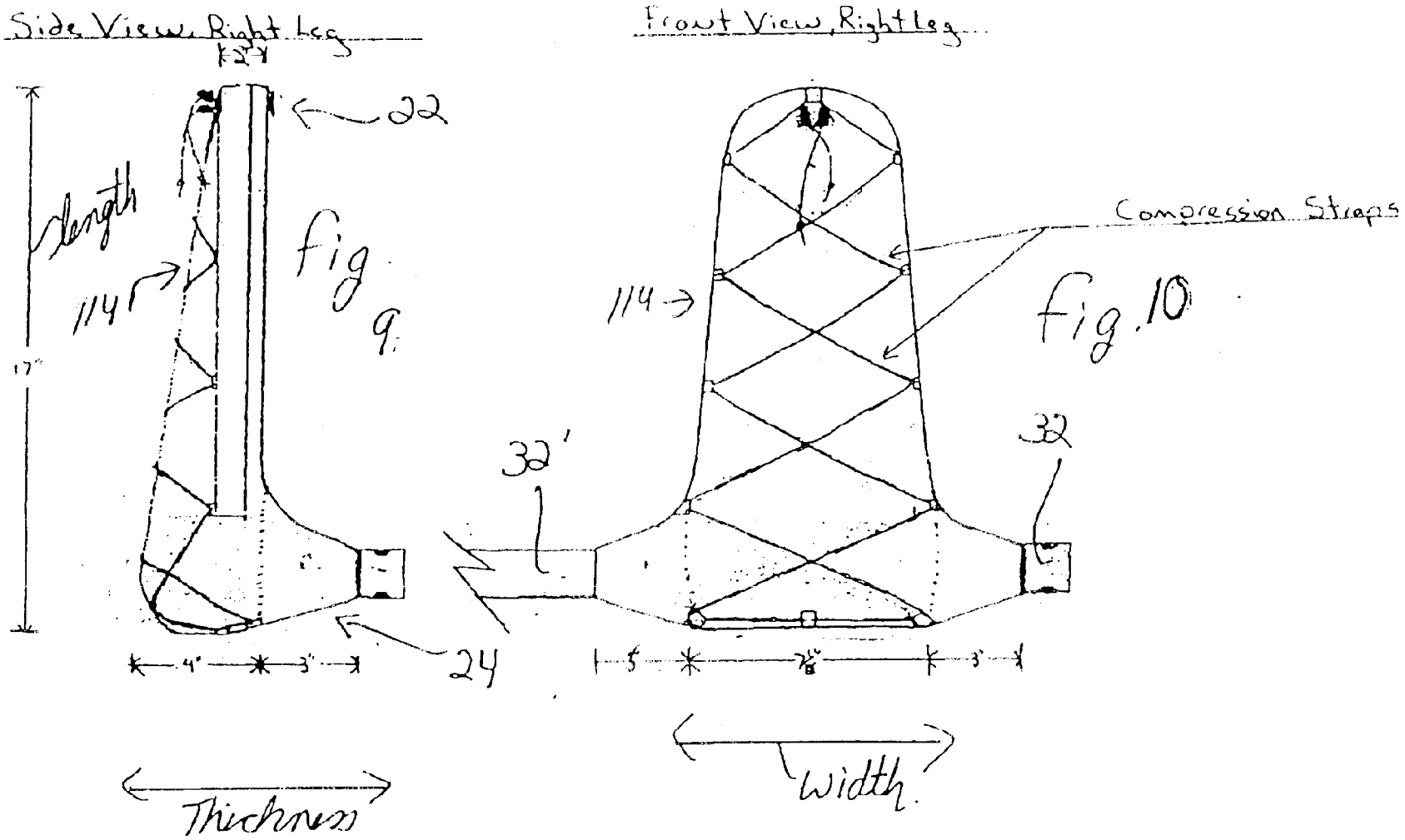
FIG. 9 is a side perspective view of the bag embodiment of FIG. 8.
FIG. 10 is a front view of the bag embodiment of FIGS. 8 and 9.

FIGS. 8–10 illustrate a thigh bag 114 with a narrow and thin top, which is preferred by some users. This narrow- and thin-topped bag does not significantly interfere with arm motion even during more extreme activities.

Figure 11:
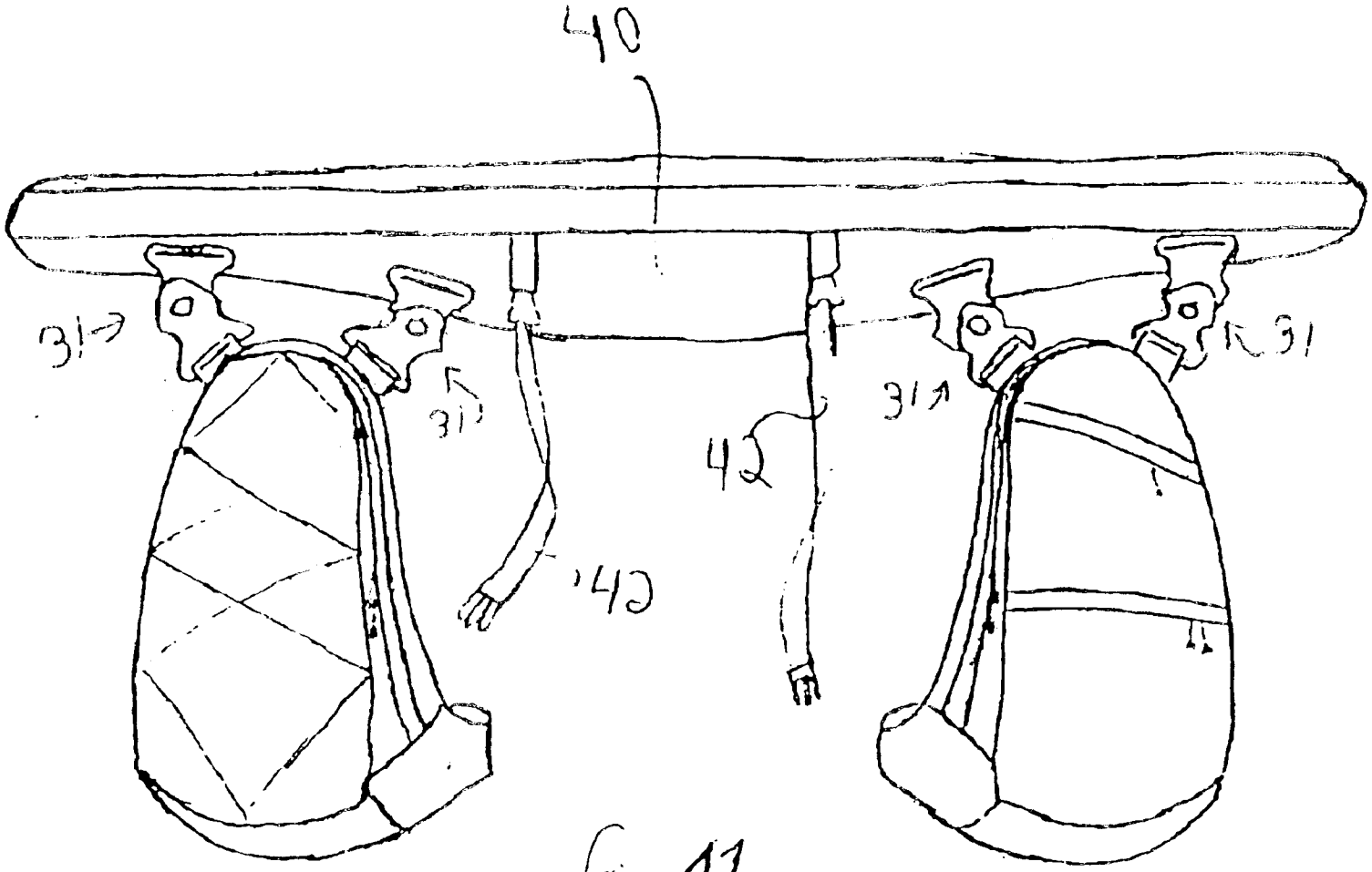
FIG. 11 is a perspective view of an alternative bag system according to the invention, including two thigh bags and two center rear straps.

A hydration unit, jacket, or other items may be held on the hip belt central rear section, for example, in the tightenable rear straps 42 on either side of center, shown in FIG. 11. A hydration unit reservoir may be attached to the centrally-located rear straps 42 and the hydration tube may be clipped to the front chest of the user.

Padding is preferably included in the back wall of the bag and in the leg strap support panels, as this adds some rigidity to the bag, and comfort for the user. The resulting back wall (also referred to as the "back plane" of the bag) is preferably generally planar, with enough flexibility that it can flex around the curvature of the thigh, preferably all along the length of the bag. This curvature contributes to the bag fitting closely to the thigh and movement naturally with the leg without wobble or other movements relative to the leg that would unbalance the user.

Figure 14C:
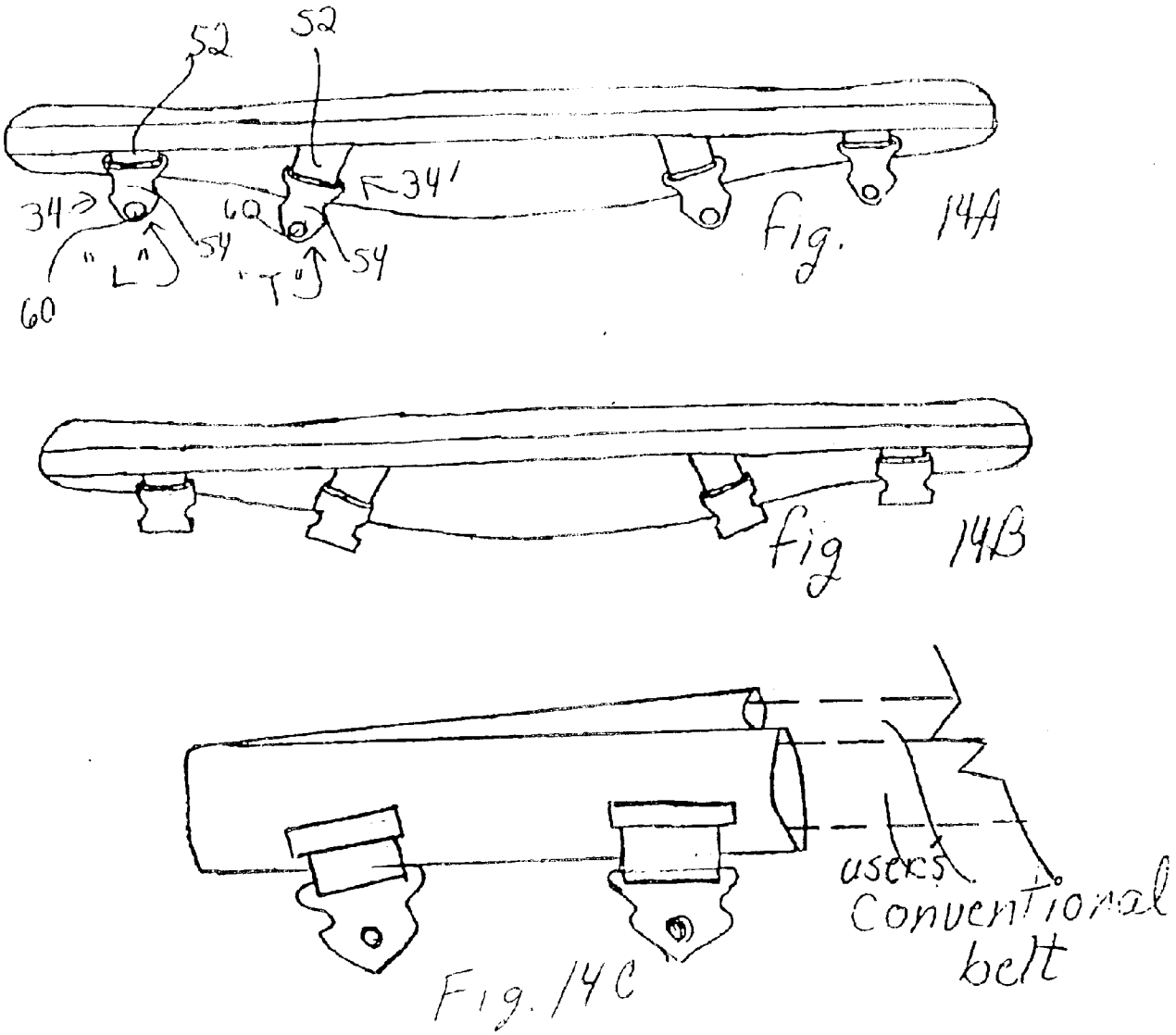
FIG. 14C illustrates another embodiment of a hip belt, which is a belt sleeve with connectors portions, wherein a conventional belt may be slid into the belt sleeve.

FIG. 14C illustrates that a "hip belt" according to the invention may include, in some embodiments, a sleeve that slides onto a conventional belt. This serves, in effect, as an adapter to make a conventional belt usable as a hip belt for the invented bag system. Preferably, the sleeve includes means for securing the sleeve to the conventional belt, either by friction, by fasteners, or other anchoring systems.

Although this invention has been described above with reference to particular means, materials and embodiments, it is to be understood that the invention is not limited to these disclosed particulars, but extends instead to all equivalents within the scope of the following claims.

I claim:

1. A modular pack system comprising:

a belt for placement around a user, the belt having two ends and a length between the two ends, the belt further having a plurality of generally rigid upper connector portions along its length, wherein at least one upper connector is near each end of the belt for being positioned above the user's outer thigh;

a plurality of bags each having at Least one generally rigid lower connector portion releaseably connected to a different one of said upper connector portions to form a plurality of pivotal connections of the bags to the belt, and each of said plurality of bags having a leg strap for extending around the user's leg above the knee, so that one of said plurality of bags is pivotally hung against each of the user's outer thighs to pivot relative to the belt with leg movement; and further wherein said pivotal connection comprises a generally rigid connector extending down below the belt and rotatably connected to the belt so that the connector is adapted to flip up to lie parallel to and near the belt.

2. The modular pack system of claim 1, further comprising two sets of two pivotal connectors, wherein the two pivotal connectors are spaced apart and at least one of the pivotal connectors is angled in toward the other.

3. The modular pack system of claim 1, wherein the belt has a center between its two ends, and each of the two sets of pivotal connectors comprises a first pivotal connector and a second pivotal connector, the first pivotal connector in each set being relatively closer to the center of the belt, and further wherein the first pivotal connector is angled toward the second pivotal connector.

4. The modular pack system of claim 1, wherein the belt has a center between its two ends, and the pack system further comprises a slide-on bag comprising a loop on its back surface adapted to slide onto the belt from one of said ends.

5. The modular pack system of claim 4, wherein said plurality of bags comprises left and right thigh bags, and said slide-on bag slides to the center of the belt.

6. The modular pack system of claim 4, wherein said plurality of bags comprises left and right thigh bags, and the pack system further comprises a plurality of side bags, each with a loop on its back surface adapted to slide onto the belt to a position above one of said left and right thigh bags.

7. The modular pack system comprising:

a belt for placement around a user, the belt having two ends and a length between the two ends, the belt further having a plurality of pairs of upper connector portions along its length, wherein at least one of the pairs of upper connectors is near each end of the belt for being positioned above the user's outer thigh;

a plurality of quick-release thigh bags each having at least one lower connector portion releaseably connected to said plurality of upper connector portions to form quick-release connections of the thigh bags to the belt, and each of said plurality of thigh bags having a leg strap for extending around the user's leg above the knee, and further wherein each of the pairs of upper connectors comprises a first connector and a second connector, and further wherein at least one of the first connector or second connector is angled toward the other.

8. A modular pack system comprising:

a belt for placement around a user, the belt having two ends and a length between the two ends, the belt further having a plurality of pairs of upper connector portions along its length, wherein at least one of the pairs of upper connectors is near each end of the belt for being positioned above the user's outer thigh;

a plurality of quick-release thigh bags each having at least one lower connector portion releaseably connected to said plurality of upper connector portions to form quick-release connections of the thigh bags to the belt, and each of said plurality of thigh bags having a leg strap for extending around the user's leg above the knee, and further wherein each of the pairs of upper connectors comprises a first connector and a second connector, and further wherein the first connector extends perpendicularly downward from the belt when the belt is in use, and the second connector is non-parallel to the first connector.

9. A modular pack system comprising:

a belt for placement around a user, the belt having two ends and a length between the two ends, the belt further having a first pair of belt connectors attached to the belt and positioned above a first one of the user's outer thighs when the belt is in use; and a first thigh bag having a first pair of thigh bag connectors releaseably attached to the first pair of belt connectors to form quick-release connections of the first thigh bag to the belt, and further wherein the first pair of belt connectors comprises a first connector and a second connector, and further wherein at least one of the first connector or second connector is angled toward the other.

10. A modular pack system comprising:

a belt for placement around a user, the belt having two ends and a length between the two ends, the belt further having a first pair of belt connectors attached to the belt and positioned above a first one of the user's outer thighs when the belt is in use; and a first thigh bag having a first pair of thigh bag connectors releaseably attached to the first pair of belt connectors to form quick-release connections of the first thigh bag to the belt, and further wherein the first pair of belt connectors comprises a first connector and a second connector, and further wherein the first connector extends perpendicularly downward from the belt when the belt is in use, and the second connector is non-parallel to the first connector.

* * * * *